US010767958B2

(12) United States Patent
Rotrekl et al.

(10) Patent No.: US 10,767,958 B2
(45) Date of Patent: Sep. 8, 2020

(54) AIR GUN

(71) Applicant: CESKA ZBROJOVKA A.S., Uhersky Brod (CZ)

(72) Inventors: Michal Rotrekl, Vlcnov (CZ); Ondrej Vonasek, Prague (CZ); Paul Van Wyk, Praha vychod (CZ); Jakub Vicher, Orlova - Lutyne (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 16/142,205

(22) Filed: Sep. 26, 2018

(65) Prior Publication Data

US 2019/0107359 A1 Apr. 11, 2019

(30) Foreign Application Priority Data

Oct. 6, 2017 (CZ) ..... PV 2017-630

(51) Int. Cl.
*F41B 11/60* (2013.01)
*F41B 11/73* (2013.01)

(52) U.S. Cl.
CPC ..... *F41B 11/60* (2013.01); *F41B 11/73* (2013.01)

(58) Field of Classification Search
CPC ..... F41B 11/60; F41B 11/62; F41B 11/64; F41B 11/68; F41B 11/72; F41B 11/721; F41B 11/723; F41B 11/724; F41B 11/73
USPC ..... 124/56, 70, 71, 72, 73, 74, 75, 76, 77
See application file for complete search history.

(56) References Cited

U.S. PATENT DOCUMENTS

| | | | | |
|---|---|---|---|---|
| 1,266,764 | A * | 5/1918 | Blair | A63B 69/409 124/81 |
| 2,634,717 | A | 4/1953 | Junkin | |
| 5,333,594 | A | 8/1994 | Robinson | |
| 5,613,483 | A | 3/1997 | Lukas et al. | |
| 5,908,024 | A * | 6/1999 | Staev | F41B 11/52 124/31 |
| 6,213,112 | B1 * | 4/2001 | Squire | F41B 11/00 124/74 |
| 6,715,480 | B2 * | 4/2004 | Dziob | F41B 11/00 124/73 |
| 7,275,530 | B2 * | 10/2007 | Deak | F41B 11/52 124/51.1 |
| 2002/0170552 | A1 | 11/2002 | Gardner | |
| 2007/0017497 | A1 | 1/2007 | Masse | |
| 2010/0154766 | A1 | 6/2010 | Skilling | |
| 2015/0300771 | A1 * | 10/2015 | Tseng | F41B 11/62 124/74 |
| 2017/0328671 | A1 * | 11/2017 | Liao | F41B 11/723 |

FOREIGN PATENT DOCUMENTS

| | | | |
|---|---|---|---|
| GB | 631797 | A | 11/1949 |
| JP | 2014240722 | A | 12/2014 |

OTHER PUBLICATIONS

Search Report from Corresponding Czech Application No. PV 2017-630 dated Jul. 3, 2018 (3 pages).

* cited by examiner

*Primary Examiner* — Bret Hayes
(74) *Attorney, Agent, or Firm* — Hovey Williams LLP

(57) ABSTRACT

An air gun with a barrel, provided with a bore, the bore being connected to the supply channel of the compressed medium. The supply channel is terminated with an annular distribution space arranged around the axis of the barrel, distribution channels connected to the barrel bore running from the annular distribution space towards the axis of the barrel.

10 Claims, 5 Drawing Sheets

AIR GUN

RELATED APPLICATIONS

The application claims the benefit of Czech Patent Application No. PV 2017-630 entitled "Air Gun", filed Oct. 6, 2017, the entire disclosure of which is incorporated herein by reference.

FIELD OF THE INVENTION

The invention relates to an air gun with a barrel provided with a bore, wherein the bore is connected to the supply channel of the compressed medium.

BACKGROUND INFORMATION

Air or gas weapons, commonly referred to as "airguns", use either pre-compressed medium to launch the projectile from the barrel, or they comprise a mechanism that ensures compression of the propelling medium, being hand-driven. An elastic element can be advantageously used that accumulates mechanical energy necessary for the shot and after triggering of the gun, it transfers this energy to a piston that exerts pressure upon the driving medium. These guns are still referred to as air guns in the application regardless of the propelling media type.

In existing solutions, at least one borehole is almost in all cases used to transport the propelling medium to the barrel during a shot, the borehole being arranged perpendicularly or obliquely to the barrel axis.

A disadvantage of these solutions is the undesired influence of the sharp transition and a narrow neck wherein the supply of the pressure medium is not fluent, is noisy, increases the pressure loss, and means high consumption of the pressure of the supplied medium.

From the prior art, systems without a borehole in the barrel are also known, wherein the medium is supplied to the barrel via the gunlock mechanism (known from solution of the company Feinwerkbau or Steyr). However, even here a sharp transition of the pressure medium is used.

It would be theoretically possible to increase the diameter of the borehole leading to the barrel to make the diameter of the borehole the same as the barrel diameter. However, in this case, the projectile would fall through this hole due to its excessive size.

For quick development of a shot and to achieve high power, it is necessary for the propelling medium (compressed air or gas) to transfer energy to the projectile as quickly as possible, along the shortest way and without losses caused by turbulences and the passage through narrow necks.

SUMMARY OF THE INVENTION

The above mentioned goal is achieved by an air gun with a barrel provided with a bore, the bore being connected to a supply channel of a compressed medium, according to the invention, the principle of which is that the supply channel is terminated with an annular distribution space arranged around the axis of the barrel, while distribution channels connected to the barrel bore run from the annular distribution space towards the axis of the barrel.

The solution according to the invention makes it possible for the propelling medium to transfer its energy to the projectile without losses caused by turbulences and the passage through narrow necks. The result is higher power and faster development of the shot compared to well-known guns of this type.

In one embodiment, the distribution channels are inclined with regard to the axis of the barrel bore at the angle $\alpha$=30 to 90 degrees.

The sum of the areas of the cross-sections of all the distribution channels is can be equal to or bigger than the area of the cross-section of the barrel bore.

In another embodiment, the distribution channels are arranged in an insert that bears on a rear face of the barrel, the insert being provided with a central opening that continues the barrel bore, and the distribution channels lead into the central opening.

The annular distribution space is can be arranged on the perimeter of the insert in the place of the distribution channels.

In another embodiment, the distribution channels are arranged in a sliding barrel lock that in its front position bears on the rear face of the barrel, the barrel lock being provided with a central opening that continues the barrel bore, and the distribution channels lead into the central opening.

The barrel lock is on its perimeter, in the place of the distribution channels, provided with the annular distribution space.

The annular distribution space is arranged between two sealing O-rings or between a sealing O-ring and a peripheral thread.

DESCRIPTION OF EMBODIMENTS OF THE INVENTION

Figure 1:
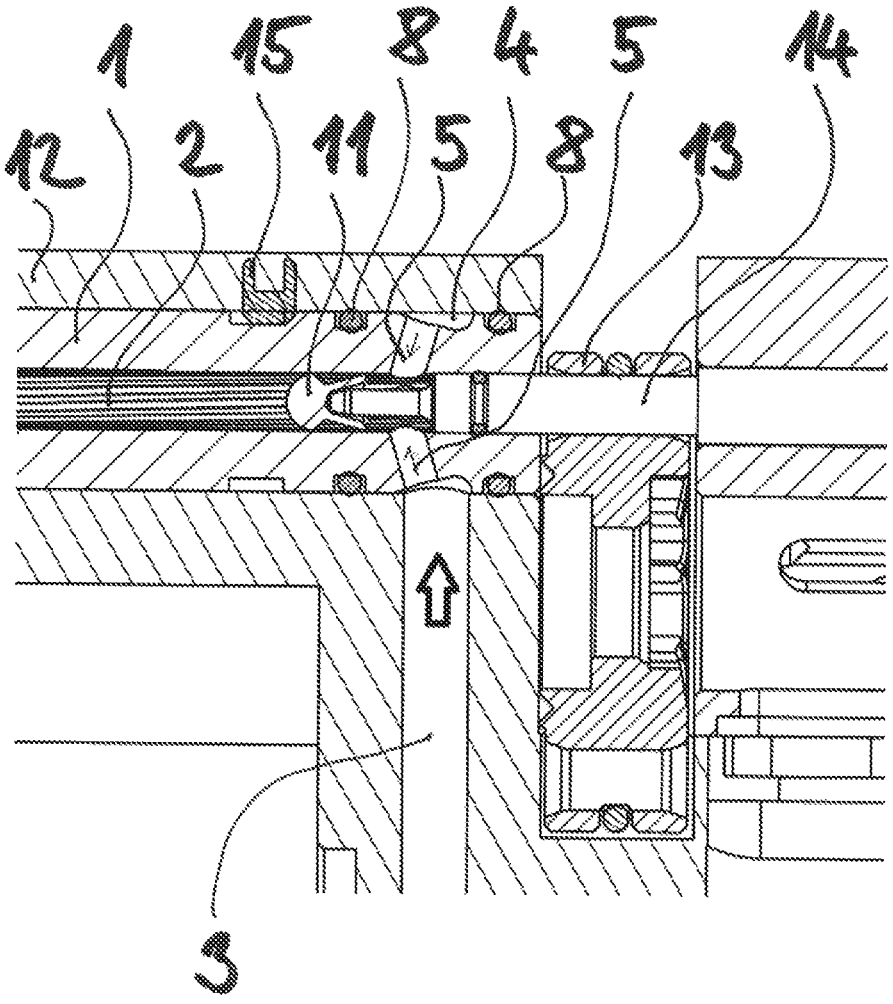
FIG. 1 shows a first embodiment of an air gun according to the invention, with channels created directly in the rear end of the barrel.

The embodiment of an air gun according to FIG. 1 has a barrel 1 with a bore 2. The barrel 1 is fixed in the body 12 of the gun with grub screws 15.

The compressed medium (air, gas) is supplied from a source, which is not shown here, via the supply channel 3 to the annular distribution space 4 arranged around the axis of the barrel 1 on the outer perimeter of the barrel 1.

The distribution space 4 is sealed with two O-rings 8. Distribution channels 5 run from the annular distribution space 4 in a star-like pattern towards the axis of the barrel 1, the channels being inclined with regard to the axis of the barrel bore 2 at the angle $\alpha$=75 degrees and leading to the bore 2 of the barrel 1. In accordance with the present invention, the distribution channels can be inclined with regard to the axis of the barrel bore at the angle $\alpha$=30 to 90 degrees.

At the rear end of the barrel 1, a rotary magazine 13 is arranged from which projectiles 11 can be moved into the bore 2 of the barrel 1 by means of a loading pin 14 mounted in a sliding manner.

To supply a sufficient quantity of air to the barrel bore 2, the sum of the areas of the cross-sections of all the distribution channels 5 can be equal to or bigger than the area of the cross-section of the barrel bore 2.

Before shooting, a mechanism, which is not shown here, is used to move the loading pin 14 in such a way that its tip can push the projectile 11 from the rotary magazine 13 into the barrel bore 2.

After pressing of a not shown trigger, the compressed medium is supplied via the supply channel 3 to the annular distribution space 4 and further via the distribution channels 5 into the barrel bore 2 so that the compressed medium ejects the prepared projectile 11 from the barrel bore 2.

Figure 2:
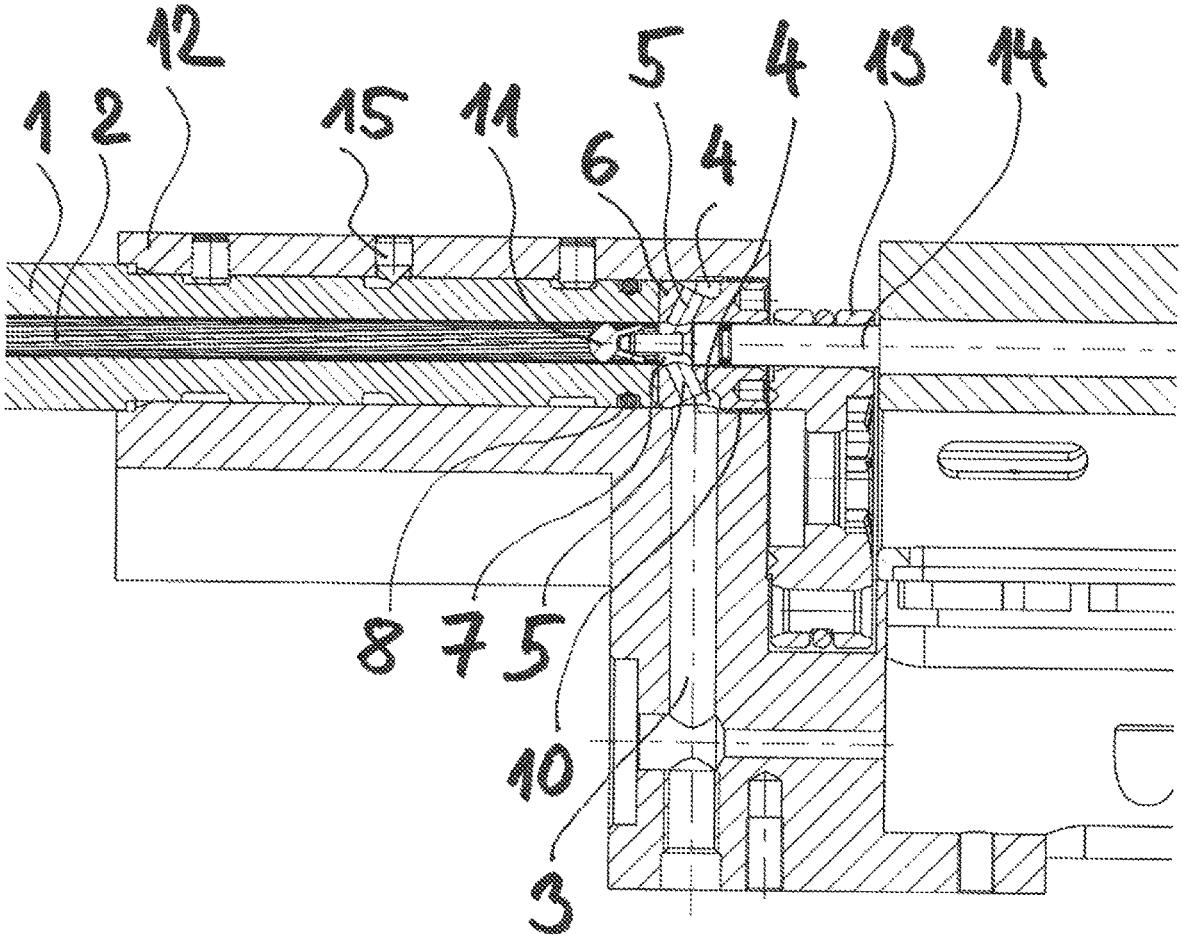
FIG. 2 shows a second embodiment of an air gun according to the invention, with channels created in a separate insert, which is shown in detail in FIGS. 3 and 4.
Figure 3:
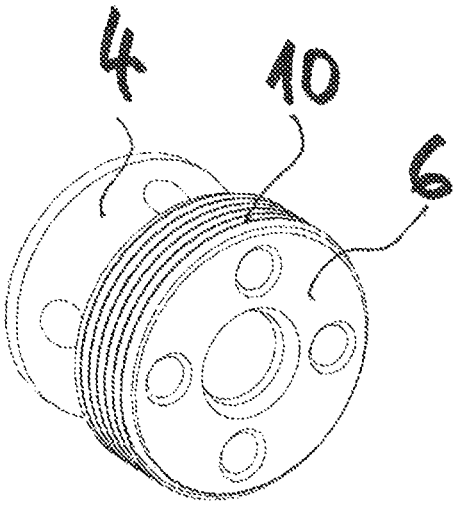
Figure 4:
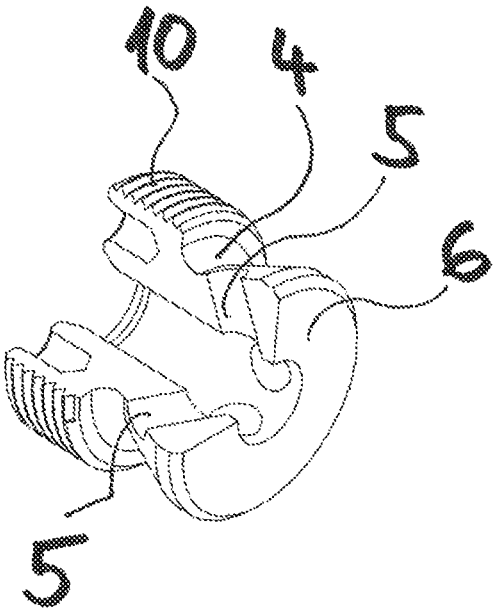

FIG. 2 shows a second embodiment of an air gun according to the invention, which differs from the embodiment of FIG. 1 in that the annular distribution space 4 and the star-like arranged distribution channels 5 are not created directly in the rear end of the barrel 1, but in a separate insert 6 that bears on the rear face of the barrel 1. The insert 6 is provided with a central opening 7 that continues the barrel bore 2, and the distribution channels 5 lead into this central opening 7. The annular distribution space 4 is arranged on the perimeter of the insert 6, in the place of the distribution channels 5. A detail of such an insert 6 is shown in FIGS. 3 and 4.

Figure 6:
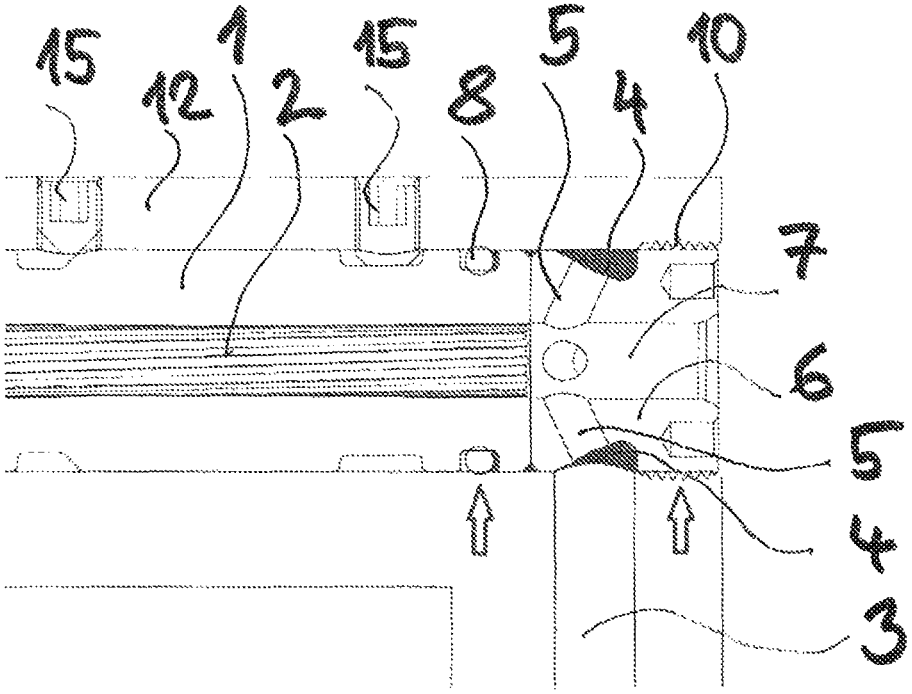
FIG. 6 shows sealing of the distribution space with an O-ring and a peripheral thread.
Figure 7:
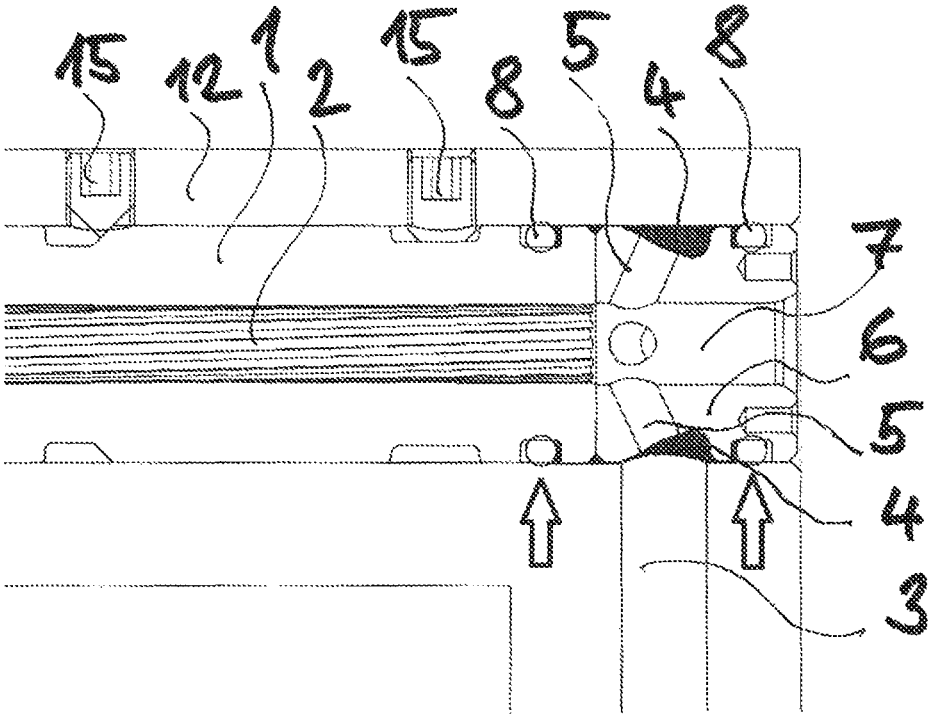
FIG. 7 shows sealing of the distribution space with two O-rings.

In the embodiment of FIG. 2, the annular distribution space 4 is sealed with a sealing O-ring 8 at one side and with a peripheral thread 10 at the other side. A detail of such a sealing is shown in FIG. 6. Naturally, the distribution space 4 can also be sealed with two O-rings 8 as shown in FIG. 7.

The function of the gun of FIG. 2 is analogous to that of the described embodiment of FIG. 1.

Figure 5:
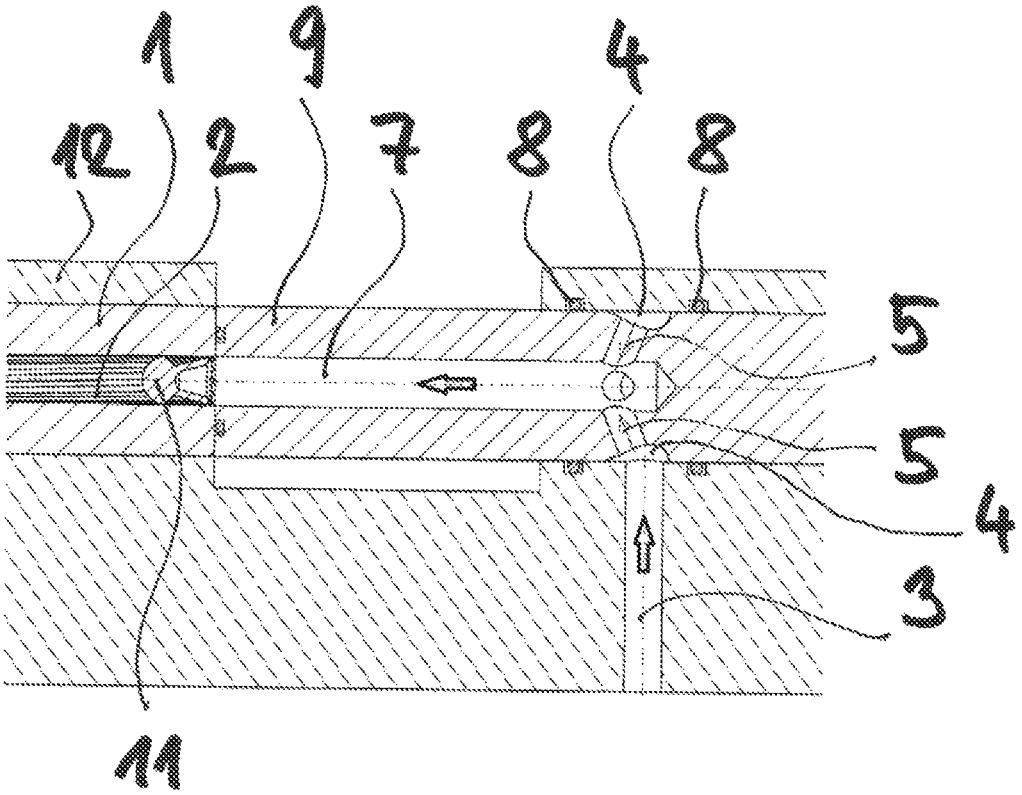
FIG. 5 shows a third embodiment of an air gun according to the invention, with channels created in the barrel lock.

FIG. 5 shows a third embodiment of an air gun according to the invention, which differs from the embodiment of FIG. 1 in that the annular distribution space 4 and the star-like arranged distribution channels 5 are created in a sliding barrel lock 9 that in its front position bears on the rear face of the barrel 1. In the barrel lock 9, a central opening 7 is created that continues the barrel bore 2, and the distribution channels 5 lead into the central opening 7.

The barrel lock 9 is on the perimeter, in the place of the distribution channels 5, provided with an annular distribution space 4 that is sealed with a pair of O-rings 8 in the front position of the lock 9.

This function of the gun of FIG. 5 is analogous to that of the embodiment of FIG. 1. Only the loading is manual, i.e. the barrel lock 9 is moved backwards, the user inserts a projectile 11 into the barrel bore 2 with his/her fingers, and the barrel lock 9 is moved forwards.

LIST OF REFERENCE SIGNS

1 barrel
2 bore
3 supply channel
4 distribution space
5 distribution channels
6 insert
7 central opening
8 O-ring
9 barrel lock
10 peripheral thread
11 projectile
12 gun body
13 magazine
14 loading pin
15 grub screw

The invention claimed is:

1. An air gun with a barrel provided with a bore, the barrel comprising a horizontal barrel axis and the bore being connected to a supply channel of a compressed medium, wherein the supply channel is terminated with an annular distribution space arranged around the horizontal barrel axis, while distribution channels connected to the bore run in a star-like pattern from the annular distribution space towards the axis of the barrel, wherein the annular distribution space is located on an outer perimeter of:

(i) the barrel, (ii) an insert that bears on a rear face of the barrel, said insert comprising a central opening that continues the barrel bore and that is coaxial with the horizontal barrel axis, or (iii) a sliding barrel lock, wherein the bore comprises a horizontal bore axis and the distribution channels are inclined with regard to the horizontal bore axis at an angle of $\alpha$=30 to 90 degrees, wherein the distribution channels are arranged in the insert and the distribution channels lead into the central opening.

2. The air gun according to claim 1, wherein the distribution channels comprise a combined cross-sectional distribution area and the barrel bore comprises a bore cross-sectional area, wherein the combined cross-sectional distribution area is equal to or greater than the bore cross-sectional area.

3. The air gun according to claim 1, wherein the annular distribution space is arranged on the outer perimeter of the insert.

4. The air gun according to claim 1, wherein the annular distribution space is arranged between two sealing O-rings.

5. The air gun according to claim 1, wherein the annular distribution space is arranged between a sealing O-ring and a peripheral thread.

6. The air gun according to claim 1, wherein the annular distribution space is arranged between two sealing O-rings.

7. The air gun according to claim 1, wherein the annular distribution space is arranged between a sealing O-ring and a peripheral thread.

8. An air gun with a barrel provided with a bore, the barrel comprising a horizontal barrel axis and the bore being connected to a supply channel of a compressed medium, wherein the supply channel is terminated with an annular distribution space arranged around the horizontal barrel axis, while distribution channels connected to the bore run in a star-like pattern from the annular distribution space towards the axis of the barrel, wherein the annular distribution space is located on an outer perimeter of:

(i) the barrel, (ii) an insert that bears on a rear face of the barrel, said insert comprising a central opening that continues the barrel bore and that is coaxial with the horizontal barrel axis, or (iii) a sliding barrel lock, wherein the bore comprises a horizontal bore axis and the distribution channels are inclined with regard to the horizontal bore axis at an angle of $\alpha$=30 to 90 degrees, wherein the distribution channels are arranged in the sliding barrel lock, wherein the sliding barrel lock comprises a front face that bears on the rear face of the barrel, the barrel lock being provided with a central opening that continues the barrel bore, and wherein the distribution channels lead into the central opening.

9. The air gun according to claim 8, wherein the distribution channels comprise a combined cross-sectional distribution area and the barrel bore comprises a bore cross-sectional area, wherein the combined cross-sectional distribution area is equal to or greater than the bore cross-sectional area.

10. The air gun according to claim 8, wherein the annular distribution space is positioned on the outer perimeter of the barrel lock.

* * * * *